United States Patent [19]

Karru et al.

[11] 4,355,691

[45] Oct. 26, 1982

[54] HYDRAULIC DRILLING APPARATUS

[75] Inventors: Esa Karru; Pekka Salmi, both of Tampere; Hannu Paasonen, Nokia; Aimo Helin, Tampere, all of Finland

[73] Assignee: Oy Tampella AB, Finland

[21] Appl. No.: 162,160

[22] Filed: Jun. 23, 1980

[30] Foreign Application Priority Data

Jun. 26, 1979 [FI] Finland ..... 792018

[51] Int. Cl.[3] ..... B25D 9/26

[52] U.S. Cl. ..... 173/106

[58] Field of Search ..... 173/105–107, 173/DIG. 3, 134; 92/2; 60/484

[56] References Cited

U.S. PATENT DOCUMENTS

| | | | |
|---|---|---|---|
| 4,006,783 | 2/1977 | Granholm | 173/105 |
| 4,028,995 | 6/1977 | Salmi et al. | 91/276 |
| 4,064,950 | 12/1977 | Salmi et al. | 173/151 |
| 4,126,192 | 11/1978 | Wallace | 173/105 |

FOREIGN PATENT DOCUMENTS

| | | | |
|---|---|---|---|
| 2053070 | 2/1981 | United Kingdom | 173/106 |

*Primary Examiner*—Werner H. Schroeder
*Assistant Examiner*—Andrew M. Falik
*Attorney, Agent, or Firm*—Hill, Van Santen, Steadman, Chiara & Simpson

[57] ABSTRACT

A hydraulic drilling apparatus, especially a rock drill comprising a body, a cylinder in the body and a percussion piston reciprocating in the cylinder. A tool is connected to the body and a motor is provided for rotating the tool. A control valve is also provided for the percussion power. A control valve is also provided for regulating the motor speed. Both of these control valves are operated independently by one lever. A hydraulically operated flushing valve is also provided. A hydraulic pump and hydraulic channels coact to form a percussion circuit and a rotation circuit is parallelly coupled with the percussion circuit in relation to the hydraulic pump. A flushing valve circuit is controlled by the percussion circuit and a circuit for the free circulation of the hydraulic pump which is parallelly coupled with the percussion circuit in relation to the hydraulic pump. The circuits are connected to the hydraulic pump. The control valves are disposed in the body of the percussion apparatus with one of these valves being in the rotation circuit for controlling the flow rate which valve is a pressure-compensated flow control valve with a throttling control.

5 Claims, 1 Drawing Figure

HYDRAULIC DRILLING APPARATUS

BACKGROUND OF THE INVENTION

1. Field of the Invention

This invention relates to a hydraulic drilling apparatus, especially a rock drill which comprises a body, a cylinder in the body and a percussion piston reciprocating in the cylinder, a tool connected to the body, a motor rotating the tool, a control valve for the percussion power, a control valve for the rotation motor speed, a hydraulically operated flushing valve, a hydraulic pump and hydraulic channels, which form a percussion circuit and a rotation circuit which are parallelly coupled in relation to the hydraulic pump, a flushing valve circuit which is controlled by the percussion circuit, and a circuit for the free circulation of the hydraulic pump which is parallelly coupled with the percussion circuit in relation to the hydraulic pump, which circuits are connected to the hydraulic pump.

2. Description of the Prior Art

A hydraulic rock drill is known through Finnish patent application 752,135, corresponding to U.S. Pat. No. 4,064,950 in which the control valves for percussion power and rotation speed are located in the control panel apart from the rock drill itself. Furthermore, the percussion apparatus and the rotation motor have separate hydraulic circuits. The maximum percussion power is adjusted by a pressure relief valve in the hydraulic circuit of the percussion mechanism and the maximum rotation power is adjusted by a pressure relief valve in the hydraulic circuit of the percussion mechanism. Because there are two separate hydraulic circuits and because the valves are arranged in a separate control panel, the control hydraulics of this known rock drill are complicated and demand many hoses, which cannot be accepted, for example, in hand tools. Because the percussion power and the rotation speed are independently controlled, they cannot be adjusted simultaneously. When drilling with a hand drill or a jack leg it is important that the percussion power and the rotation speed are adjusted in a certain way dependent on each other to ensure that the collaring of a hole always succeeds. Further it is important that the flushing valve is forced to open before the percussion mechanism starts to work. For example, in coal mines the operation must not be reversed.

On the other hand, such known rock drills (hand drills) in which the operation valve is built in the drill body are all pneumatic. In these drills the drill steel is rotated by means of a ratchet mechanism which is operated by the movement of the percussion piston. Because of such mechanism, the rotation speed cannot be adjusted, for example, after different kinds of rock.

The object of this invention is to accomplish a hydraulic drilling apparatus of the type mentioned above, in which the elements for adjusting percussion power and rotation speed can be simultaneously controlled even with hand drills, and in which the rotation speed can be adjusted to a desired standard value which remains constant in a wide area independent of the rotation resistance.

This object is achieved through the features of the invention which are evident from the following detailed description of the preferred embodiment of the invention.

DESCRIPTION OF THE PREFERRED EMBODIMENT

Figure 1:
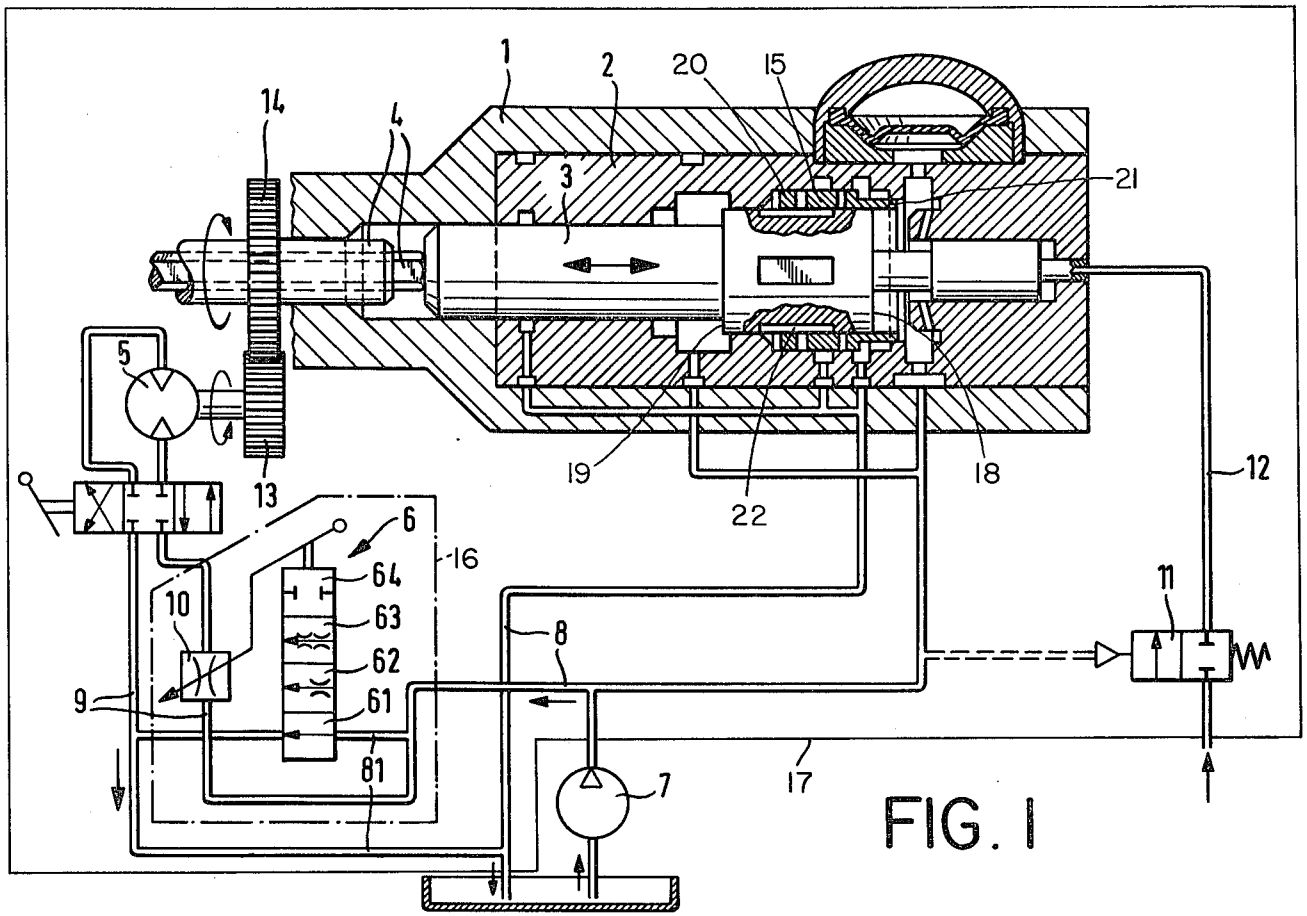

As shown in FIG. 1, the drilling machine comprises a body 1, in which there is a cylinder 2 and a percussion piston 3 reciprocating in the cylinder. To the body 1 there is connectfed a tool 4 which is acted on by the percussion piston 3 on one side, and by the rotation motor 5 on the other side. Transmission of power from the rotation motor to the tool 4 is shown schematically by gears 13 and 14. The percussion power of the percussion piston 3 is controlled by control valve or adjustable throttle valve 6 as later described. The hydraulic pump 7 feeds oil to the percussion circuit 8 and to the rotation circuit 9 which is parallelly coupled with the percussion circuit. Drilling a hole in a rock produces cuttings of rock at the bottom of the hole. These cuttings must be flushed out from the hole with a medium such as water or air. This process is called "flushing". The flushing circuit 12 comprises a flushing valve 11 which is controlled by the percussion circuit 8. Control valve 6 for the percussion power is coupled to the free circulation 81 of the hydraulic pump 7 and further to the rotation speed control valve 10 so that they can be operated interdependently by one control lever. The distributing valve 15 is reciprocating along with the piston 3 at the same frequency as the piston but in a different phase compared thereto. The operation of the piston 3 and the distributing valve 15 is fully detailed in Finnish Pat. No. 50940, corresponding to U.S. Pat. No. 4,028,995, and is briefly described as follows:

In the following "down", and "under" and "lower" mean that end of the apparatus to which the tool is attached and "up", "above" and "upper" the opposite end of the apparatus.

The principle of the operation is that at the upper end of the distributor valve 15 and the lower end of the piston 3 there is always a hydraulic pressure. At the other ends of them the hydraulic pressure is brought only when needed. At the upper end of the piston 3 the pressure is brought when the piston 3 has to strike and at the lower end of the distribution valve 15 when the valve has to change its position for making the piston return.

At the beginning of a stroke the piston 3 is at its upper position and the distributor valve 15 is at its lower position.

The hydraulic pressure at both ends of the piston 3 is the same, but since the area of the upper face 18 of the piston is larger than the area of the lower face 19, the imbalanced force makes the piston move down.

Shortly before the piston 3 is at its lower position the hydraulic fluid passes through the canals 22 in the piston to the lower end of the distributor valve 15. The area of the lower face 20 of the valve 15 is larger than the upper face 21. Since there is the same pressure at both ends the imbalanced force makes the valve 15 move up.

At its upper position the distributor valve 15 prevents the hydraulic fluid from flowing above the piston 3 and at the same time allows the fluid above the piston 3 flow out therefrom.

There is now a hydraulic pressure only at the lower end of the piston 3 and therefore the piston starts to move up.

When the piston 3 moves up, it first prevents the hydraulic fluid from flowing under the distributor valve 15 and after that allows the fluid under the valve to flow out through the canals 22 in the piston 3.

As there is no pressure at the lower end of the distributor valve 15, it starts moving down allowing the hydraulic fluid to flow above the piston 3 and the stroke starts again.

In the invention a unit comprising control valves 6 and 10, indicated schematically by dotted line 16, is attached to the body of the drilling apparatus itself, said attachment indicated schematically by line 17, whereby both percussion power and rotation speed are interdependently controllable by one control lever during work, even with hand drills. The interdependency of control valves 6 and 10 is arranged as follows. During the first position 61 of control valve 6 the free circulation 81 of the pump is fully open and the rotation circuit 9 is closed. The percussion piston 3 and the rotation motor 5 are not working. During the second position 62 of the control valve 6 the free circulation circuit 81 is throttled so much that pressure in the hydraulic circuit 8 rises enough to open the flushing valve 11. The percussion piston 3 and the rotation motor 5 are still not working. During the third position 63 of the control valve 6 the free circulation circuit 81 is throttled so much that pressure in the percussion circuit 8 reaches a predetermined value which initiates the movement of the percussion piston 3. Simultaneously the hydraulic circuit 9 of the rotation motor 5 is opened by control valve 10 to the extent that the flow rate in it rises enough to start the rotation motor 5. During the fourth position 64 of the control valve 6 the free circulation 81 is completely closed. Simultaneously, the throttle in the rotation circuit 9 has opened to its largest predetermined value, which means that the flow rate has its maximum value. Now the percussion power and the rotation speed are maximal. Preferably, the control valve 6 is an adjustable throttle valve which can be adjusted between a fully open position and a fully closed position. Thus, between the third and fourth positions of the valve 6 the percussion power and the rotation speed can be adjusted between the starting power limit and the maximum valve.

The rotation speed control valve 10 is a pressure-compensated flow control valve, which makes it possible for example to adjust a desired maximum speed for the rotation motor.

Compared with throttling control only, the pressure-compensated flow control valve has the advantage that the rotation speed is in a wide area independent of the rotation resistance which means that the rotation speed remains constant.

We claim:

1. A hydraulic drilling apparatus, especially a rock drill, comprising a body, a cylinder in said body, a percussion piston reciprocating in said cylinder, a tool connected to said body, a motor rotating said tool, a control valve for the percussion power, a control valve for the rotational motor speed, both of said control valves being operated interdependently by one lever, a hydraulically operated flushing valve, a hydraulic pump and hydraulic channels which form a percussion circuit and a rotation circuit, said rotation circuit being parallelly coupled with said percussion circuit and operatively connected with said hydraulic pump, a flushing valve circuit controlled by said percussion circuit, and a free circulation circuit operatively connected with said hydraulic pump, said circulation circuit being parallelly coupled with said percussion circuit.

2. The hydraulic drilling apparatus according to claim 1, wherein said control valve for the percussion power and said control valve for the rotational motor speed are attached to said body.

3. The hydraulic apparatus according to claim 1, wherein said control valve for the rotational motor speed is a pressurecompensated flow control valve with throttling control.

4. A hydraulic drilling apparatus according to claim 1, wherein said control valve for the percussion power comprises an adjustable throttle valve in said free circulation circuit of said hydraulic pump, said adjustable throttle valve being adjustable between a fully open position and a fully closed position; whereby in a first position of said adjustable throttle valve said free circulation circuit is fully open and said rotation circuit is closed; in a second position of said adjustable throttle valve the pressure in said percussion circuit is increased to a first predetermined value by throttling said free circulation circuit to the extent that pressure in said percussion circuit rises enough to open said flushing valve; in a third position of said adjustable throttle valve said free circulation circuit is throttled further to the extent that the pressure in said percussion circuit reaches a second predetermined value which initiates the stroke of said piston, and simultaneously said rotation circuit is opened by said control valve for the rotational motor speed to the extent that the flow rate therein rises to a value to start said rotation motor; in a fourth position of said adjustable throttle valve said free circulation circuit is fully closed and simultaneously said control valve for the rotational motor speed is opened to its largest predetermined value.

5. The hydraulic drilling apparatus according to claim 4, wherein said adjustable throttle valve is continuously adjustable between said third position and said fourth position.

* * * * *